US007624825B2

(12) United States Patent
Singh

(10) Patent No.: US 7,624,825 B2
(45) Date of Patent: Dec. 1, 2009

(54) DRILL BIT AND CUTTER ELEMENT HAVING AGGRESSIVE LEADING SIDE

(75) Inventor: Amardeep Singh, Houston, TX (US)

(73) Assignee: Smith International, Inc., Houston, TX (US)

( * ) Notice: Subject to any disclaimer, the term of this patent is extended or adjusted under 35 U.S.C. 154(b) by 409 days.

(21) Appl. No.: 11/253,121

(22) Filed: Oct. 18, 2005

(65) Prior Publication Data

US 2007/0084640 A1 Apr. 19, 2007

(51) Int. Cl.
*E21B 10/16* (2006.01)

(52) U.S. Cl. ..... 175/430; 175/426; 175/431

(58) Field of Classification Search ..... 175/426, 175/428, 430, 431
See application file for complete search history.

(56) References Cited

U.S. PATENT DOCUMENTS

| | | | | |
|---|---|---|---|---|
| 3,388,757 | A | | 6/1968 | Fittinger |
| 3,442,352 | A | | 5/1969 | McElya et al. |
| 4,056,153 | A | | 11/1977 | Miglierini |
| 4,058,177 | A | | 11/1977 | Langford, Jr. et al. |
| 4,086,973 | A | | 5/1978 | Keller et al. |
| 4,108,260 | A | | 8/1978 | Bozarth |
| 4,334,586 | A | | 6/1982 | Schumacher |
| 4,586,574 | A | | 5/1986 | Grappendorf |
| 4,607,712 | A | * | 8/1986 | Larsson ..... 175/426 |
| 4,716,977 | A | | 1/1988 | Huffstutler |
| 4,722,405 | A | | 2/1988 | Langford, Jr. |
| 4,832,139 | A | | 5/1989 | Minikus et al. |
| 5,131,478 | A | | 7/1992 | Brett et al. |
| 5,172,777 | A | | 12/1992 | Siracki et al. |
| 5,172,779 | A | | 12/1992 | Siracki et al. |
| 5,197,555 | A | | 3/1993 | Estes |
| 5,201,376 | A | | 4/1993 | Williams |
| 5,322,138 | A | | 6/1994 | Siracki |

(Continued)

FOREIGN PATENT DOCUMENTS

| | | |
|---|---|---|
| EP | 0 527 506 | 2/1993 |

(Continued)

OTHER PUBLICATIONS

Search Report of Appl. No. GB0620387.1 dated Jan. 17, 2007; (5 p.).

(Continued)

*Primary Examiner*—Shane Bomar
*Assistant Examiner*—Robert E Fuller
(74) *Attorney, Agent, or Firm*—Conley Rose, P.C.

(57) ABSTRACT

A cutter element for a drill bit includes a leading cutting surface and a trailing cutting surface. The leading surface includes a top surface and a front surface that meet in a radiused intersection forming a forward-facing, non-linear crest of non-uniform radius. The radius of the crest is smallest at the forward-most portion, and greater at each end. The crest has its largest radius at a location between its forward-most portion and one of its ends. The cutter element may be employed in the corner cutting portion of a rolling cone cutter in a drill bit, the cutter element being positioned such that the forward-most portion of the crest first engages the formation material, with the crest end having the largest radius being closest to the pin end of the bit.

26 Claims, 8 Drawing Sheets

U.S. PATENT DOCUMENTS

| | | | |
|---|---|---|---|
| 5,323,865 | A | 6/1994 | Isbell et al. |
| 5,341,890 | A | 8/1994 | Cawthorne et al. |
| 5,351,768 | A | 10/1994 | Scott et al. |
| 5,372,210 | A | 12/1994 | Harrell |
| 5,379,854 | A | 1/1995 | Dennis |
| 5,407,022 | A | 4/1995 | Scott et al. |
| 5,415,244 | A | 5/1995 | Portwood |
| 5,421,424 | A | 6/1995 | Portwood et al. |
| 5,479,997 | A | 1/1996 | Scott et al. |
| 5,535,839 | A | 7/1996 | Brady |
| 5,542,485 | A | 8/1996 | Pessier et al. |
| 5,560,440 | A | 10/1996 | Tibbitts |
| 5,592,995 | A | 1/1997 | Scott et al. |
| 5,636,700 | A | 6/1997 | Shamburger, Jr. |
| 5,695,019 | A | 12/1997 | Shamburger, Jr. |
| 5,697,462 | A | 12/1997 | Grimes et al. |
| 5,709,278 | A | 1/1998 | Crawford |
| 5,743,346 | A | 4/1998 | Flood et al. |
| 5,746,280 | A | 5/1998 | Scott et al. |
| 5,752,573 | A | 5/1998 | Scott et al. |
| 5,755,301 | A | 5/1998 | Love et al. |
| 5,813,485 | A | 9/1998 | Portwood |
| 5,819,861 | A | 10/1998 | Scott et al. |
| 5,833,020 | A | 11/1998 | Portwood et al. |
| 5,839,526 | A | 11/1998 | Cisneros et al. |
| 5,871,060 | A | 2/1999 | Jensen et al. |
| 5,881,828 | A | 3/1999 | Fischer et al. |
| 5,890,550 | A | 4/1999 | Swadi et al. |
| 5,915,486 | A | 6/1999 | Portwood et al. |
| 5,950,745 | A | 9/1999 | Ingmarsson |
| 5,967,245 | A | 10/1999 | Garcia et al. |
| 6,029,759 | A | 2/2000 | Sue et al. |
| 6,053,263 | A | 4/2000 | Meiners |
| 6,059,054 | A | 5/2000 | Portwood et al. |
| 6,105,693 | A | 8/2000 | Ingmarsson |
| 6,105,694 | A | 8/2000 | Scott |
| 6,119,798 | A | 9/2000 | Fischer et al. |
| 6,161,634 | A | 12/2000 | Minikus et al. |
| 6,176,333 | B1 | 1/2001 | Doster |
| 6,196,340 | B1 | 3/2001 | Jensen et al. |
| 6,199,645 | B1 | 3/2001 | Anderson et al. |
| 6,241,034 | B1 | 6/2001 | Steinke et al. |
| 6,367,568 | B2 | 4/2002 | Steinke et al. |
| 6,561,293 | B2 | 5/2003 | Minikus et al. |
| 6,745,645 | B2 | 6/2004 | Griffo |
| 6,782,959 | B2 | 8/2004 | Minikus et al. |
| 6,883,623 | B2 | 4/2005 | McCormick et al. |
| 6,883,624 | B2 | 4/2005 | McDonough |
| 2001/0004026 | A1 | 6/2001 | Lockstedt et al. |
| 2002/0108789 | A1 | 8/2002 | Schautt |
| 2004/0149493 | A1 | 8/2004 | McDonough |
| 2004/0163851 | A1 | 8/2004 | McDonough et al. |
| 2004/0173384 | A1 | 9/2004 | Yong et al. |
| 2005/0023043 | A1 | 2/2005 | Tufts |
| 2006/0260846 | A1 * | 11/2006 | Portwood et al. ..... 175/331 |

FOREIGN PATENT DOCUMENTS

| | | |
|---|---|---|
| GB | 2 361 497 | 10/2001 |
| GB | 2 369 841 | 6/2002 |
| GB | 2398330 | 8/2004 |
| GB | 2427633 | 3/2007 |
| RU | 2105124 | 2/1998 |
| RU | 2153569 | 7/2000 |
| WO | WO 01/61142 | 8/2001 |

OTHER PUBLICATIONS

Search Report for Appln. No. GB 0 403 620.8 dated May 5, 2004 (2 p.).

Search Report for Appln. No. GB 0 402 108.5 dated Apr. 22, 2004; (1 p.).

Search Report for Appln. No. GB 0 416617.9 dated Sep. 9, 2004; (1 p.).

Search Report for Appln. No. GB 0404709.8 dated Sep. 23, 2004; (1 p.).

* cited by examiner

DRILL BIT AND CUTTER ELEMENT HAVING AGGRESSIVE LEADING SIDE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

1. Technical Field

The disclosure herein generally relates to earth boring bits used to drill a borehole for the ultimate recovery of oil, gas or minerals. More particularly, the disclosure relates to rolling cone rock bits and to an improved cutting structure and cutter elements for such bits.

2. Description of the Related Art

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole thus created will have a diameter generally equal to the diameter or "gage" of the drill bit.

An earth-boring bit in common use today includes one or more rotatable cutters that perform their cutting function due to the rolling movement of the cutters acting against the formation material. The cutters roll and slide upon the bottom of the borehole as the bit is rotated, the cutters thereby engaging and disintegrating the formation material in their path. The rotatable cutters may be described as generally conical in shape and are therefore sometimes referred to as rolling cones or rolling cone cutters. The borehole is formed as the action of the rotary cones remove chips of formation material which are carried upward and out of the borehole by drilling fluid which is pumped downwardly through the drill pipe and out of the bit.

The earth disintegrating action of the rolling cone cutters is enhanced by providing the cutters with a plurality of cutter elements. Cutter elements are generally of two types: inserts formed of a very hard material, such as tungsten carbide, that are press fit into undersized apertures in the cone surface; or teeth that are milled, cast or otherwise integrally formed from the material of the rolling cone. Bits having tungsten carbide inserts are typically referred to as "TCI" bits or "insert" bits, while those having teeth formed from the cone material are known as "steel tooth bits." In each instance, the cutter elements on the rotating cutters break up the formation to form the new borehole by a combination of gouging and scraping or chipping and crushing.

In oil and gas drilling, the cost of drilling a borehole is very high, and is proportional to the length of time it takes to drill to the desired depth and location. The time required to drill the well, in turn, is greatly affected by the number of times the drill bit must be changed before reaching the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Accordingly, it is always desirable to employ drill bits which will drill faster and longer, while maintaining a full diameter borehole.

The length of time that a drill bit may be employed before it must be changed depends upon its rate of penetration ("ROP"), as well as its durability. Bit durability is, in part, measured by a bit's ability to "hold gage," meaning its ability to maintain a full gage borehole over the entire length of the borehole. Gage holding ability is particularly vital in directional drilling applications which have become increasingly important. If gage is not maintained at a relatively constant dimension, it becomes more difficult, and thus more costly, to insert drilling apparatus into the borehole than if the borehole had a uniform diameter. For example, when a new, unworn bit is inserted into an undergage borehole, the new bit will be required to ream the undergage hole as it progresses toward the bottom of the borehole. Thus, by the time it reaches the bottom, the bit may have experienced a substantial amount of wear that it would not have experienced had the prior bit been able to maintain full gage. This unnecessary wear will shorten the bit life of the newly-inserted bit, thus prematurely requiring the time consuming and expensive process of removing the drill string, replacing the worn bit, and another new bit downhole.

The geometry and positioning of the cutter elements upon the cone cutters greatly impact bit durability and ROP, and thus are critical to the success of a particular bit design. To assist in maintaining the gage of a borehole, conventional rolling cone bits typically employ a heel row of hard metal inserts on the heel surface of the rolling cone cutters. The heel surface is a generally frustoconical surface and is configured and positioned so as to generally align with and ream the sidewall of the borehole as the bit rotates. The inserts in the heel surface contact the borehole wall with a sliding motion and thus generally may be described as scraping or reaming the borehole sidewall. The heel inserts function to maintain a constant gage and to prevent the erosion and abrasion of the heel surface of the rolling cone. Excessive wear of the heel inserts leads to an underage borehole, decreased ROP, increased loading on the other cutter elements on the bit, and may accelerate wear of the cutter bearing and ultimately lead to bit failure.

In addition to the heel row cutter elements, conventional bits typically include a gage row of cutter elements mounted adjacent to the heel surface but orientated and sized in such a manner so as to cut the corner of the borehole. In this orientation, the gage cutter elements generally are required to cut portions of both the borehole bottom and sidewall. The lower surface of the gage row insert engages the borehole bottom while the radially outermost surface scrapes the sidewall of the borehole. Conventional bits also include a number of additional rows of cutter elements that are located on the cones in rows disposed radially inward from the gage row. These cutter elements are sized and configured for cutting the bottom of the borehole and are typically described as inner row or bottomhole cutter elements.

One conventional shape for an insert used to cut the borehole corner is a hemispherical or dome-shaped cutter element. This shape provides substantial strength and durability; however, it lacks aggressiveness as it removes formation material via a rubbing motion and provides little shearing as is useful in increasing the rate of removal of material. While other, sharper and more aggressive shapes potentially could be employed to cut the borehole corner, such shapes are not as durable as the partial dome-shaped cutter element, leading to lower ROP and footage drilled, and possibly requiring a premature trip of the drill string to change the bit. Thus, while they may initially remove material at a faster rate, gage cutter elements having aggressively-shaped cutting surfaces may suffer more damage and breakage compared to rounded, less aggressive cutter elements.

Increasing bit ROP while maintaining good cutter element life to increase the total footage drilled of a bit is an important goal in order to decrease drilling time and recover valuable oil and gas more economically. Accordingly, there remains a need in the art for a drill bit and cutting structure that is durable and will lead to greater ROPs and an increase in footage drilled while maintaining a full gage borehole.

SUMMARY OF THE PREFERRED EMBODIMENTS

Accordingly, there is described herein a cutter element for a drill bit including a cutting surface having a leading section and a trailing section, where the leading section includes a non-linear crest. The crest is formed at the intersection of a top surface and a front surface. The front surface may be generally frustoconical and taper toward the trailing section at an angle of less than 20°. The crest includes a non-uniform radius along its length. In one particular embodiment, the radius of the crest is smallest adjacent to the forward-most portion of the crest, with the ends of the crest having a larger radius. The forward-most portion of the crest is farther from the trailing section than are the ends of the crest, and is also farther from the cutter element's base than the ends. Further, in this particular embodiment, the radius of the crest is greatest at a position between the leading most portion and one of the ends. In certain embodiments, the portion of the crest having the largest radius has a radius that is at least five times larger than the radius of the crest at the forward-most portion. The crest creates a prow-like, forward-facing cutting surface applicable for shearing formation material, and yet provides greater durability than, for example, a chisel-shaped cutting portion having a relatively sharper cutting edge.

The trailing section of the cutter element may include a partial dome-shaped surface adjacent to the leading section, and a transition surface extending between the partial dome-shaped surface and the base portion of the insert.

In another embodiment, the cutter element may include a relieved region on the trailing surface. In particular, the relieved region or portion may lie between the partial dome-shaped surface and the transition surface.

The cutter element may include an alignment indicator, such as a groove or scored line, to provide an aid in orienting the cutter element in an appropriate position in a rolling cone cutter.

Also provided is a drill bit including one or more rolling cone cutters and including an insert having a forward-facing, non-linear crest of non-uniform radius. In one example, the cutter element is mounted in the rolling cone cutter such that a forward-most portion of the leading crest is first to engage the formation. In an embodiment in which the portion of the crest having the smallest radius is located at the forward-most portion and the region of maximum radius is located between the forward-most portion and one end of the crest, the cutter element is oriented in the cone cutter such that the region of maximum radius is closer to the pin end of the drill bit than it is to the bottom of the borehole when the cutter element contacts the borehole.

The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a more detailed description of the preferred embodiments, reference will now be made to the accompanying drawings, wherein.

DETAILED DESCRIPTION OF THE PREFERRED EMBODIMENT

Figure 1:
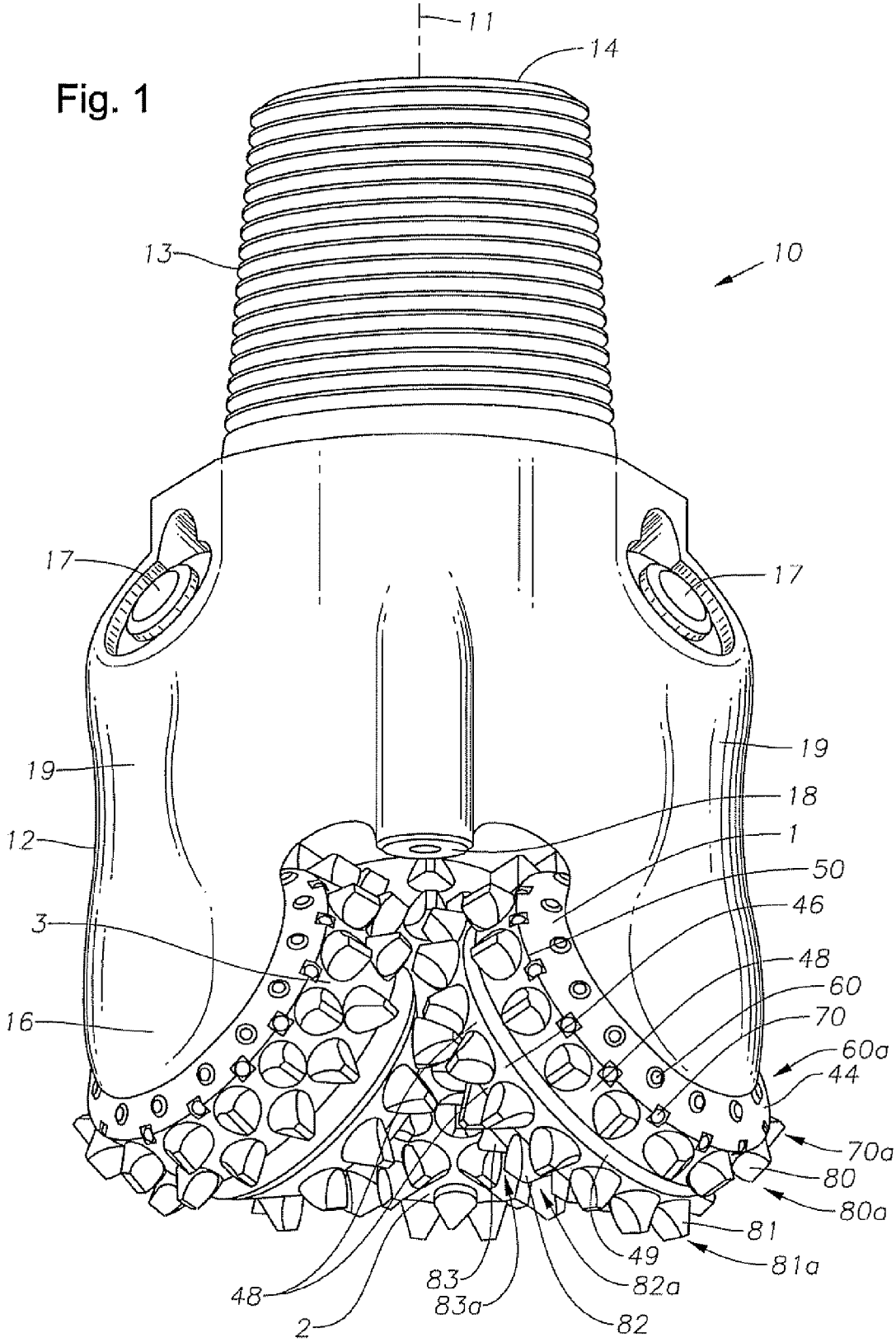
FIG. 1 is a perspective view of an earth-boring bit made in accordance with the principles described herein.

Referring first to FIG. 1, an earth-boring bit 10 is shown to include a central axis 11 and a bit body 12 having a threaded pin section 13 at its upper end that is adapted for securing the bit to a drill string (not shown). The uppermost end will be referred to herein as pin end 14. Bit 10 has a predetermined gage diameter as defined by the outermost reaches of three rolling cone cutters 1, 2, 3 which are rotatably mounted on bearing shafts that depend from the bit body 12. Bit body 12 is composed of three sections or legs 19 (two shown in FIG. 1) that are welded together to form bit body 12. Bit 10 further includes a plurality of nozzles 18 that are provided for directing drilling fluid toward the bottom of the borehole and around cone cutters 1-3. Bit 10 includes lubricant reservoirs 17 that supply lubricant to the bearings that support each of the cone cutters. Bit legs 19 include a shirttail portion 16 that serves to protect the cone bearings and cone seals from damage as might be caused by cuttings and debris entering between leg 19 and its respective cone cutter.

Figure 2:
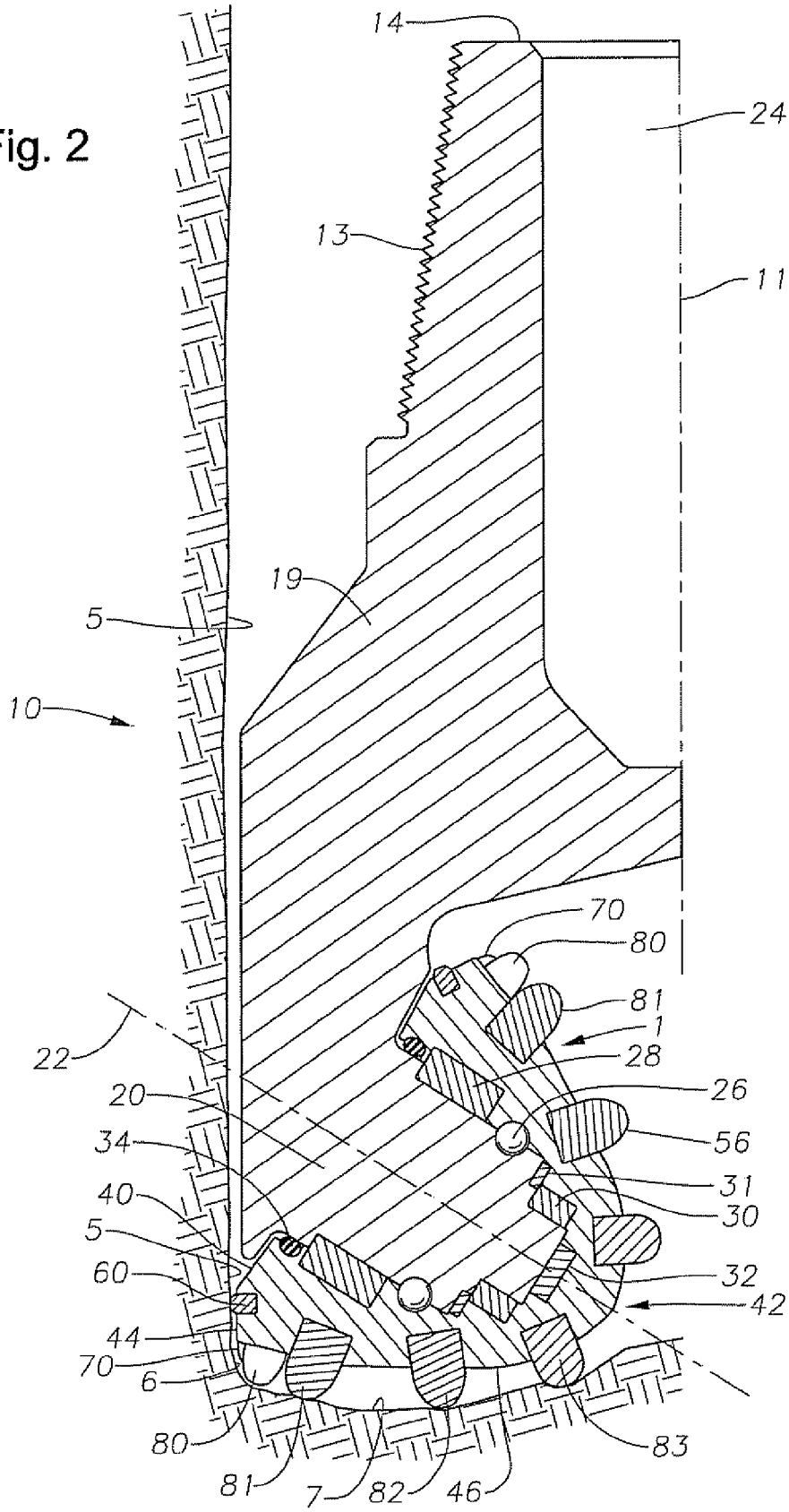
FIG. 2 is a partial section view taken through one leg and one rolling cone cutter of the bit shown in FIG. 1.
Figure 3:
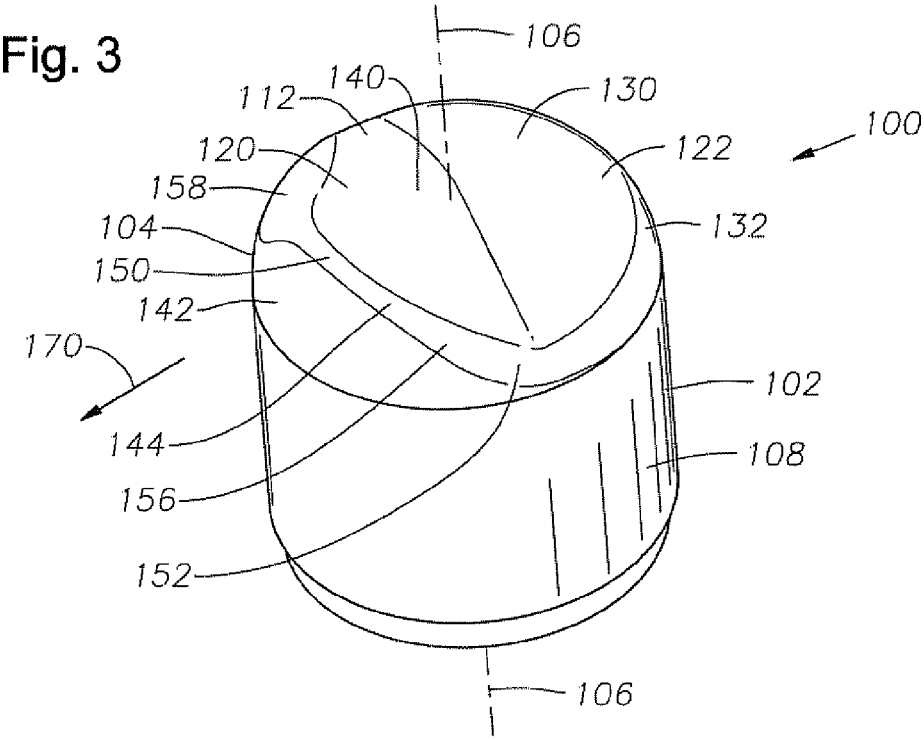
FIG. 3 is a perspective view of a cutter element useful in the drill bit shown in FIGS. 1 and 2.

Referring now to both FIGS. 1 and 2, each cone cutter 1-3 is mounted on a pin or journal 20 extending from bit body 12, and is adapted to rotate about a cone axis of rotation 22 oriented generally downwardly and inwardly toward the center of the bit. Each cutter 1-3 is secured on pin 20 by locking balls 26, in a conventional manner. In the embodiment shown, radial and axial thrust are absorbed by roller bearings 28, 30, thrust washer 31 and thrust plug 32. The bearing structure shown is generally referred to as a roller bearing; however, the invention is not limited to use in bits having such structure, but may equally be applied in a bit where cone cutters 1-3 are mounted on pin 20 with a journal bearing or friction bearing disposed between the cone cutter and the journal pin 20. In both roller bearing and friction bearing bits, lubricant may be supplied from reservoir 17 to the bearings by apparatus and passageways that are omitted from the figures for clarity. The lubricant is sealed in the bearing structure, and drilling fluid excluded therefrom, by means of an annular seal 34 which may take many forms. Drilling fluid is pumped from the surface through fluid passage 24 where it is circulated through an internal passageway (not shown) to nozzles 18 (FIG. 1). The borehole created by bit 10 includes sidewall 5, corner portion 6 and bottom 7, best shown in FIG. 2.

Referring still to FIGS. 1 and 2, each cutter 1-3 includes a generally planar backface 40 and nose portion 42. Adjacent to backface 40, cutters 1-3 further include a generally frustoconical surface 44 that is adapted to retain cutter elements that scrape or ream the sidewalls of the borehole as the cone cutters rotate about the borehole bottom. Frustoconical surface 44 will be referred to herein as the "heel" surface of cone cutters 1-3, it being understood, however, that the same surface may be sometimes referred to by others in the art as the "gage" surface of a rolling cone cutter.

Extending between heel surface 44 and nose 42 is a generally conical surface 46 adapted for supporting cutter elements that gouge or crush the borehole bottom 7 as the cone cutters rotate about the borehole. Frustoconical heel surface 44 and conical surface 46 converge in a circumferential edge or shoulder 50, best shown in FIG. 1. Although referred to herein as an "edge" or "shoulder," it should be understood that shoulder 50 may be contoured, such as by a radius, to various degrees such that shoulder 50 will define a contoured zone of convergence between frustoconical heel surface 44 and the conical surface 46. Conical surface 46 is divided into a plurality of generally frustoconical regions or bands 48 generally referred to as "lands" which are employed to support and secure the cutter elements as described in more detail below. Grooves 49 are formed in cone surface 46 between adjacent lands 48.

In the bit shown in FIGS. 1 and 2, each cone cutter 1-3 includes a plurality of wear resistant inserts 60, 70, 80, 81-83 which are arranged in circumferential rows. More specifically, rolling cone cutter 1 includes a plurality of heel inserts 60 that are secured in a circumferential row 60*a* in the frustoconical heel surface 44. Cone cutter 1 further includes a first circumferential row 70*a* of gage inserts 70 secured to cone cutter 1 in locations along or near the circumferential shoulder 50. Additionally, the cone cutter includes a second circumferential row 80*a* of gage inserts 80. The cutting surfaces of inserts 70, 80 each extend to full gage diameter. Row 70*a* of the gage inserts is sometimes referred to as the binary row and inserts 70 sometimes referred to as binary row inserts. The cone cutter 1 further includes inner row inserts 81, 82, 83 secured to cone surface 46 and arranged in concentric, spaced-apart inner rows 81*a*, 82*a*, 83*a*, respectively. Heel inserts 60 generally function to scrape or ream the borehole sidewall 5 to maintain the borehole at full gage and prevent erosion and abrasion of the heel surface 44. Gage inserts 70, 80 function primarily to cut the corner of the borehole. Inner row cutter elements 81, 82, 83 of inner rows 81*a*, 82*a*, 83*a* are employed to gouge and remove formation material from the remainder of the borehole bottom 7. Insert rows 81*a*, 82*a*, 83*a* are arranged and spaced on a rolling cone cutter 1 so as not to interfere with rows of inner row cutter elements on the other cone cutters 2, 3. Cone cutters 2 and 3 have heel, gage and inner row cutter elements that are similarly, although not identically, arranged as compared to cone 1. The arrangement of cutter elements differs as between the three cones in order to leave no uncut portion of the borehole bottom, and also to provide clearance for the cutter elements on the adjacent cone cutters.

Inserts 60, 70, 80-83 each include a generally cylindrical base portion with a central axis, and a cutting portion that extends from the base portion and includes a cutting surface for cutting the formation material. All or a portion of the base portion is secured by interference fit into a mating socket drilled into the surface of the cone cutter. The "cutting surface" of an insert is defined herein as being that surface of the insert that extends beyond the surface of the cone cutter. The extension height of the cutter element is the distance from the cone surface to the outermost point of the cutting surface (relative to the cone axis) as measured parallel to the insert's axis.

A cutter element particularly suited for use as gage inserts 70, 80 is shown in FIGS. 3-8 and is identified by reference numeral 100. Cutter element 100 includes a generally cylindrical base portion 102 and a cutting portion 104 extending therefrom. Base portion 102 includes a central axis 106, a generally cylindrical side surface 108, diameter 109, and height 110. Cutting portion 104 includes a cutting surface 112 extending from a plane of intersection 113 that separates base portion 102 from cutting portion 104. Cutting surface 112 extends from intersection 113 a height 114 such that the cutter element 100 includes an overall length or height 115.

Figure 5:
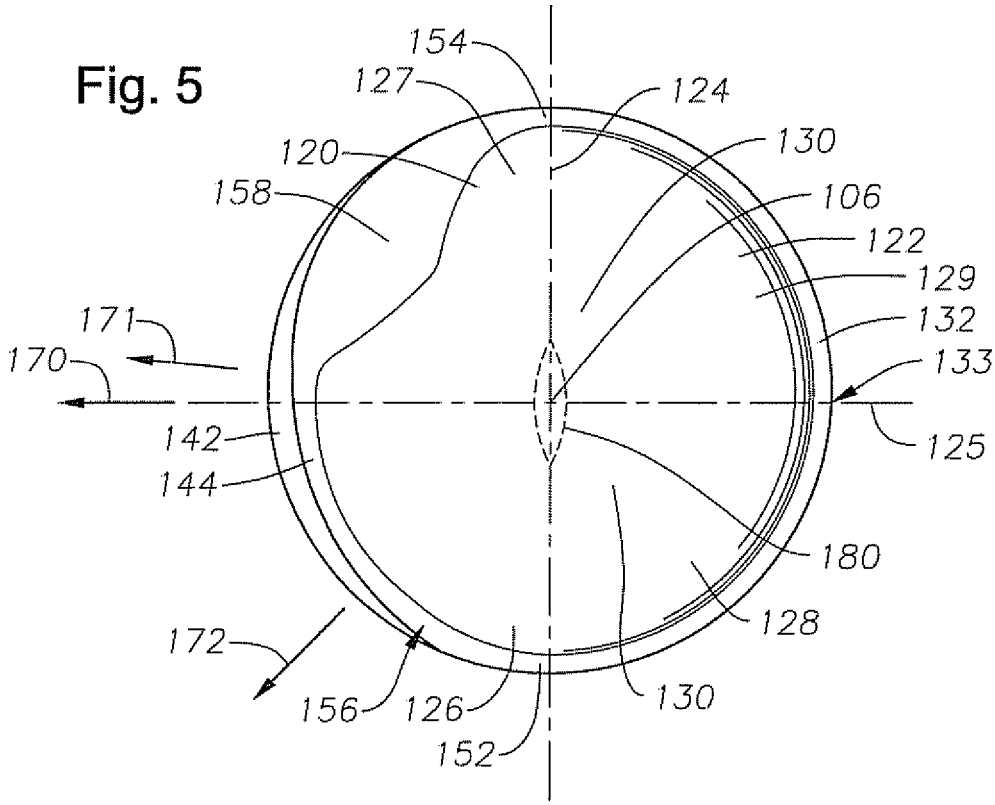
FIG. 5 is a top view of the cutter element shown in FIG. 3.
Figure 7:
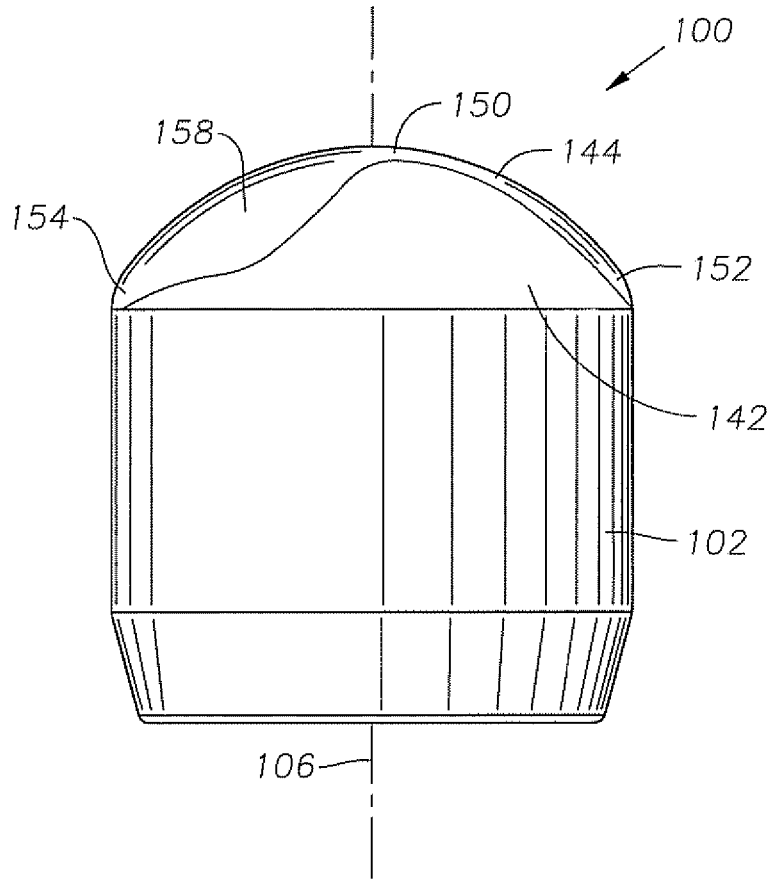
FIG. 7 is a front elevation view of the cutter element shown in FIG. 3.
Figure 8:
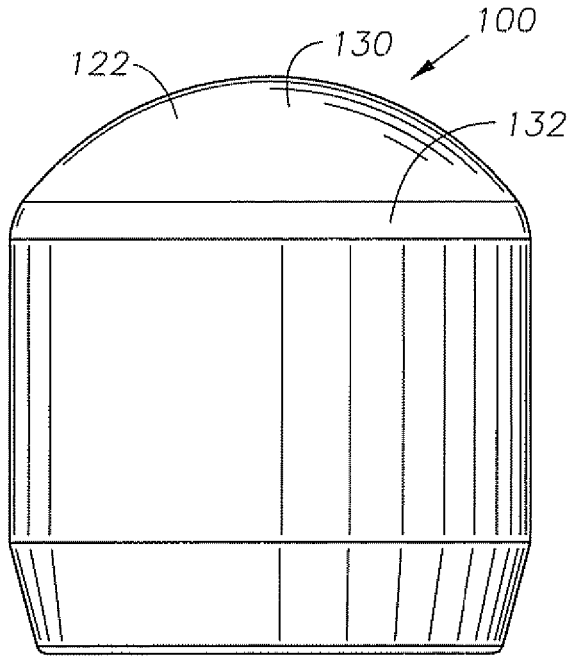
FIG. 8 is a rear elevation view of the cutter element shown in FIG. 3.

As best shown in FIG. 5, a reference plane 124 extending longitudinally and encompassing base axis 106 generally divides cutting surface 112 into a leading side or section 120 and a trailing side or section 122. A second longitudinally-extending reference plane 125 likewise encompasses base axis 106 and is generally perpendicular to plane 124. Plane 125 further divides cutting surface 112 so as to form four cutting surface quadrants: leading lower quadrant 126, leading upper quadrant 127, trailing lower quadrant 128, and trailing upper quadrant 129. In this context, the references to upper and lower are mere terms of convenience. A particular orientation for cutter element 100 when positioned in a rolling cone cutter is described more fully below. In certain embodiments, insert 100 will be positioned in the cone cutter such that it will cut in the direction represented by arrow 170. Other orientations may be employed. For example, insert 100 may be positioned within a cone cutter such that it cuts in the directions shown by arrows 171 or 172, or anywhere in between those directions. The intersection of cutting surface 112 with reference plane 124 presents a rounded, partial dome-shaped profile as best shown in FIGS. 7 and 8. In certain embodiments, the cutting surface 112 is generally hemispherical.

Trailing side 122 of the cutting surface includes a partial dome-shaped surface 130 and a rear transition surface 132. Partial dome-shaped surface 130 extends generally from reference plane 124 rearward. Transition surface 132 transitions between cylindrical side surface 108 of the base portion to the partial dome-shaped surface 130. In one particular example, where base diameter 109 is approximately 0.25 inches, the partial dome-shaped cutting surface 130 will include a generally spherical radius of approximately 0.145 inches, and the rear transition surface 132 has a smaller radius of approximately 0.050 inches at its rearward-most point 133.

Figure 4:
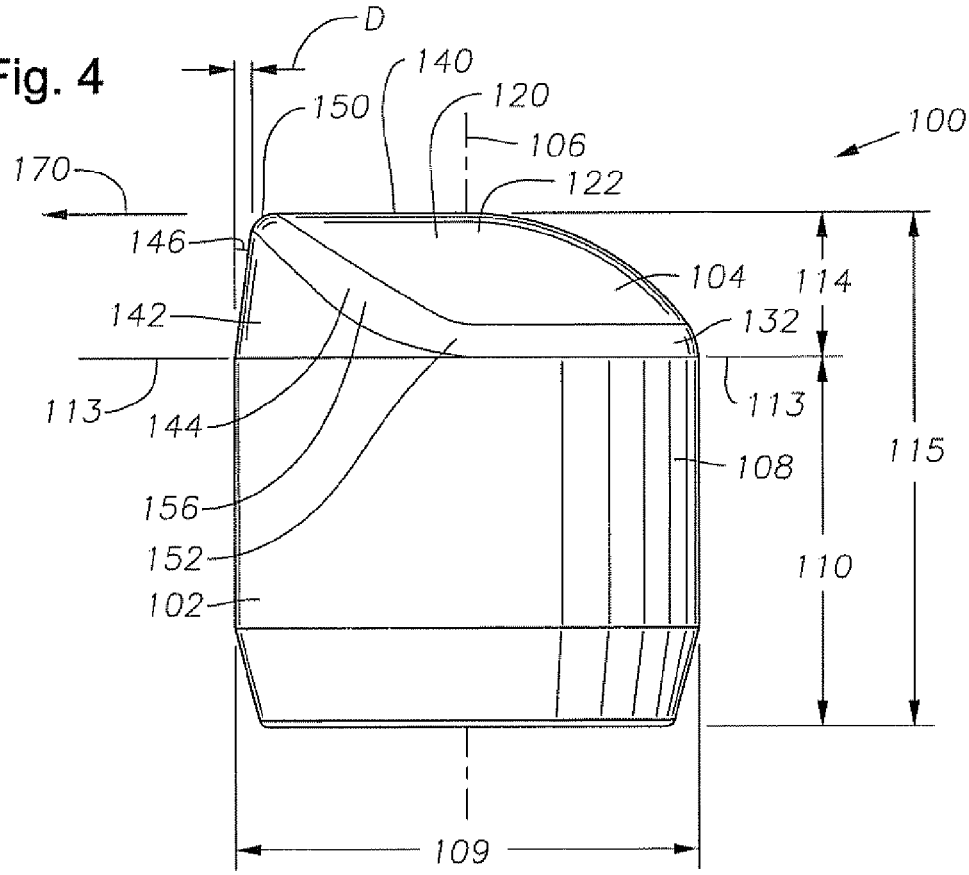
FIG. 4 is a side elevation view of the cutter element shown in FIG. 3.
Figure 6:
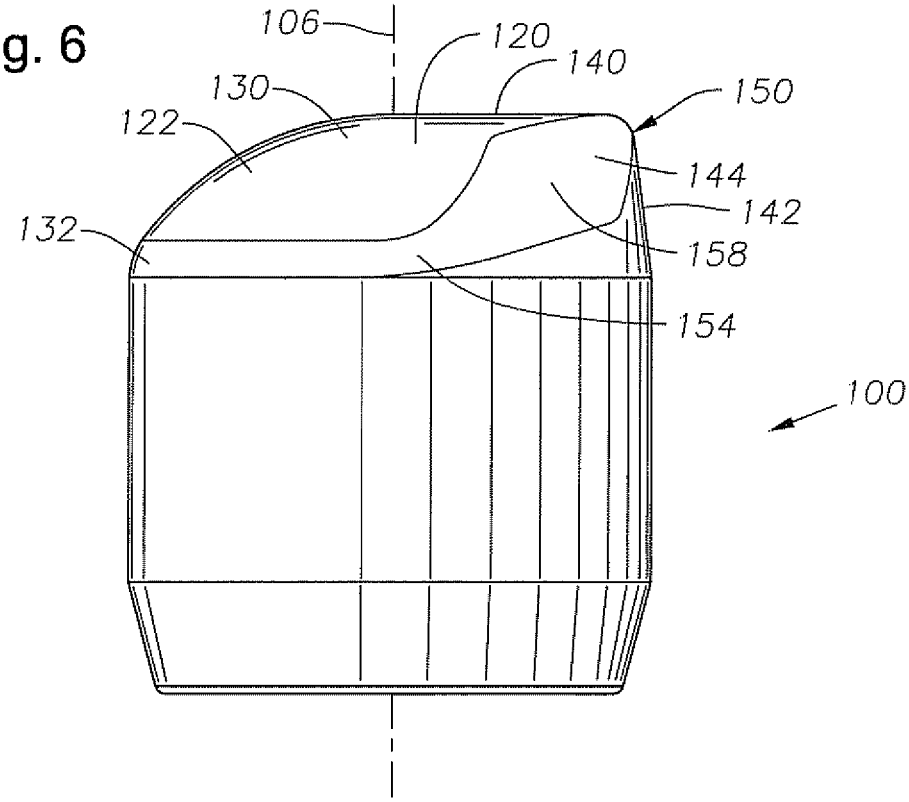
FIG. 6 is a side elevation view of the cutter element shown in FIG. 3.

Leading side 120 generally includes a front or forward-facing surface 142 and a top surface 140. As best shown in FIGS. 4 and 6, the top surface 140 of leading side 120 has a generally flat profile. From plane 124, top surface 140 extends toward and meets generally frustoconical front surface 142, intersecting in a leading crest 144. Top surface 140 extends from plane 124 generally along a tangent to the generally dome-like surface 130 of trailing side 122, where the tangent is taken where leading and trailing surfaces 120, 122 intersect at reference plane 124. As shown in FIG. 4, frustoconical front surface 142 likewise presents a generally flat profile, one that tapers inward towards axis 106 from a projection of cylindrical side surface 108. Front surface 142 forms a front relief angle 146 which, in this example, is approximately 10-12°. Given the relief angle, the forward-most portion 150 of crest 144 is offset from the projection of the cylindrical base by a distance D. As expressed as a percentage of the base diameter 109 of cutter element 100, the offset D provided by the front relief angle 146 is within the range of approximately 3 to 10% of the diameter.

Leading crest 144 extends from the forward-most or leading portion 150 to lower and upper crest ends 152, 154, respectively. Crest 144 is substantially non-linear in two perspectives. First, as shown in FIG. 5, crest 144 curves rearward from leading portion 150 to crest ends 152, 154. Likewise, as best shown in FIG. 7, crest 144 is bowed in the longitudinal direction of base axis 106, wherein leading portion 150 is further from base portion 102 than each of crest ends 152, 154. Ends 152, 154 generally intersect rear transition surface 132 at the locations where crest 144 intersects reference plane 124.

Leading crest 144 is generally formed by the intersection of top surface 140 and front surface 142, the intersection being radiused to eliminate sharp edges. Between ends 152, 154, the radius of this intersection is non-uniform and varies along its arcuate or curved length. In this example, crest 144 has the smallest radius at leading portion 150. Moving from leading portion 150 to lower end 152, the radius of the crest gradually increases. In this example (where the insert base has a diameter of approximately 0.25 inch), the crest radius at portion 150 (the radius between frustoconical front surface 142 and top surface 140 as viewed in profile) is approximately 0.010 inches. The radius of leading crest 144 at lower end 152 is approximately 0.040 inches in this example. Further, in this particular example, leading crest 144 has a radius of approximately 0.025 inches at intermediate region 156, which is located approximately ⅔ of the arcuate distance between leading portion 150 and lower end 152. Moving in the opposite direction along crest 144, its radius gradually increases from leading portion 150 toward upper end 154. The radius of crest 144 is greatest at a position 158, generally halfway between leading portion 150 and upper end 154 and is present in the leading upper quadrant 127. At this position of maximum radius 158, crest 144 has a radius of approximately 0.065 inch in this example. The radius of crest 144 decreases from position 158 moving toward upper end 154, the crest having a radius of approximately 0.050 inches at end 154 where the crest merges with rear transition section 132 at reference plane 124. Other radii may be employed for crest 144; however, it is preferred that the radius be smallest at the leading portion 150 and largest at a position in the leading upper quadrant 127. The radius at ends 152, 154 be the same or may differ. Given this geometry, the leading portion 150 of crest 144 is substantially sharper than each end of the crest and, in particular, by virtue of its smaller radius, is at least 3 times sharper. This geometry also provides that the leading portion 150 of crest 144 have a radius that is at least four times smaller than the radius of crest 144 at position 158 of maximum radius. In other examples, the leading portion 150 of crest 144 may have a radius that is three to seven times smaller than the portion of the crest 144 having maximum radius.

Given this geometry, it will likewise be understood that the cutting surface 112 may be fairly described as having a generally sharper leading side 120 compared to trailing side 122. Likewise, leading crest 144 is generally sharpest at leading portion 150 because of the differing radii used along the length of crest 144, the leading side 120 may generally be described as being sharper along leading lower quadrant 126 and less sharp or blunter in leading upper quadrant 127. Likewise, the crest itself may be said to be sharper in leading lower quadrant 126 as compared to leading upper quadrant 127. As understood from the description above, the cutting surface 112 is entirely asymmetric, meaning that no plane containing axis 106 divides the cutter element 100 into symmetrical portions.

Figure 9:
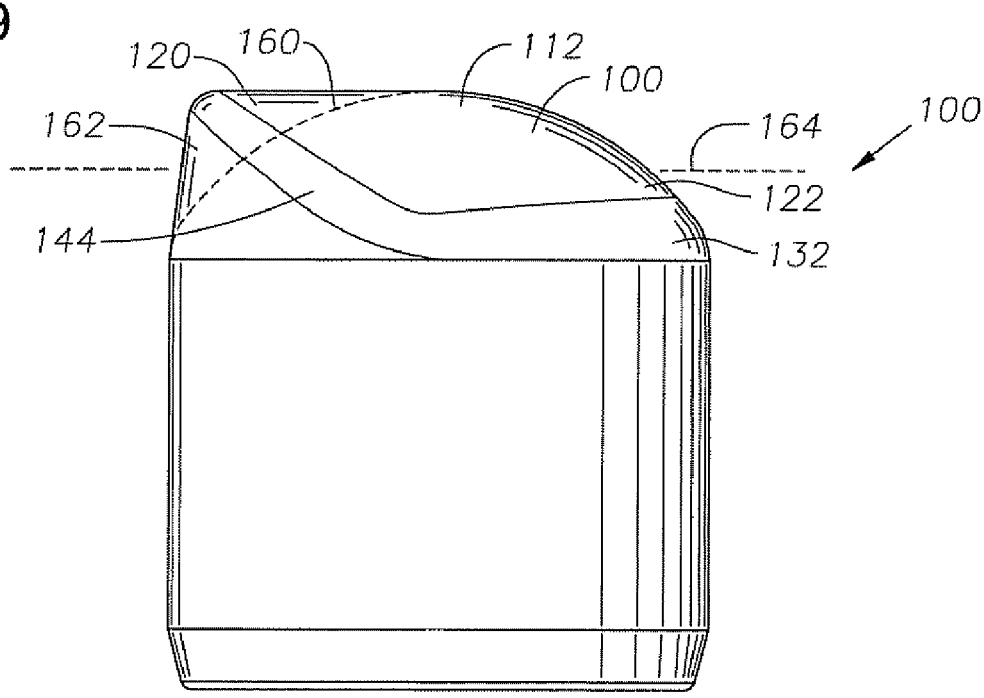
FIG. 9 is a side elevation view of the cutter element of FIG. 3 with the profile of a conventional cutter element shown in phantom for comparison.

Referring to FIG. 9, the profile view of cutter element 100 illustrates differences compared to a conventional dome-shaped insert. In this Figure, the profile of a conventional insert having a generally hemispherical top surface is shown with dashed line 160. As understood, the rear profile of cutting surface 112 of cutter element 100 generally conforms to the rearward profile of the conventional hemispherical element. However, it can be seen that the cutter element 100 includes a substantial increase in volume of insert material as compared to the hemispherical-shaped cutting surface. This added volume is represented by the generally prow-shaped portion 162 on the leading side 120. In addition to providing a cutting shape advantageous for shearing formation material, cutting surface 112 provides approximately 16% additional volume of insert material as compared to the prior art hemispherical-shaped cutting surface. Further, in this example where insert 100 includes a base diameter of 0.25 and an overall height of 0.280, once the insert 100 has worn 0.080 inch as represented by reference plane 164, the cutter element 100 has a volume of insert material that is about 37% greater compared to a similarly dimensioned (diameter and length) hemispherical shaped cutting surface. This increase in the insert's volume potentially provides enhancements in cutter element durability and thus bit life.

Figure 10:
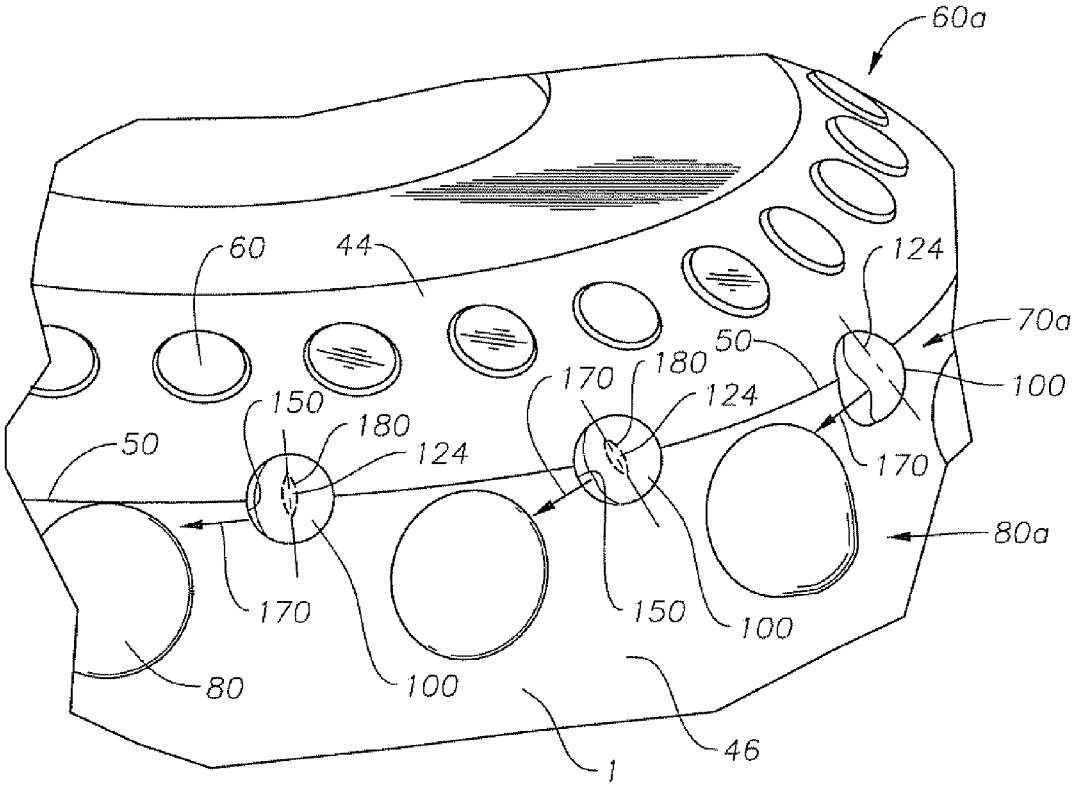
FIG. 10 is a partial perspective view of the cutter element shown in FIGS. 3-8 as mounted in a rolling cone drill bit.

Insert 100 may be mounted various places in a rolling cone cutter. FIG. 10 depicts insert 100 mounted in one exemplary location, in gage row 70*a* of cone cutter 1. In this particular example, cone 1 includes a circumferential row 60*a* of heel row inserts 60 on heel surface 44. Another gage row 80*a* having a plurality of gage inserts 80 is disposed adjacent to row 60*a* on generally conical surface 46. Disposed between rows 60*a* and 80*a* is row 70*a* of gage inserts 100. Cutter elements 100 are press-fit into the cone cutter 1 adjacent to circumferential shoulder 50 to a depth such that leading crest 144 extends to full gage diameter. In this example, insert 100 is oriented in cone cutter 1 such that insert 100 will first contact the borehole with its arcuate crest 144 and, in particular, with the sharpest portion of the crest 144, the leading portion 150. The cutting direction or direction of strike of cutter element 100 on the borehole is represented by arrow 170.

Figure 11:
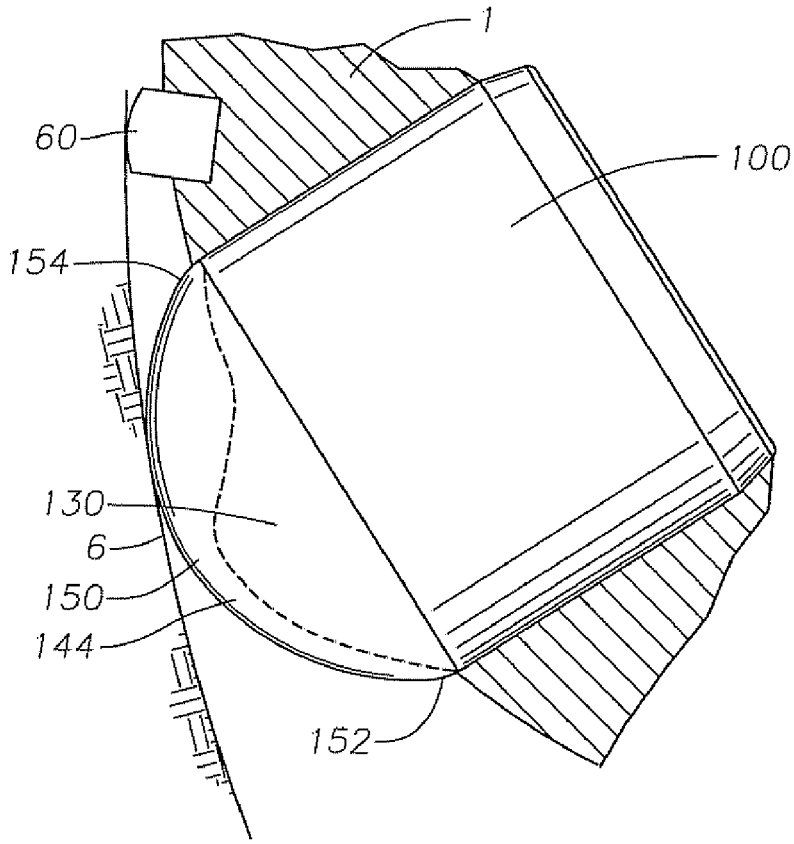
FIG. 11 is an enlarged, partial cross-sectional view of the cone cutter and cutter element of FIGS. 3-8 as the cutter element engages the borehole.

Referring to FIG. 11, cutter insert 100, so oriented, is shown in a profile view from trailing side 122, as insert 100 engages the formation to help form the borehole. In this view, the leading side 120 and leading crest 144 are not visible, crest 144 being shown in phantom. As understood with reference to FIGS. 10 and 11, as cone cutter 1 rotates in the borehole, leading surface 120 and crest 144 first engage the borehole. As the cone continues to rotate, crest 144 leaves engagement with the borehole and trailing side 122 then rotates against and then out of contact with the borehole sidewall. As best understood with reference to FIGS. 5 and 10, reference plane 124 is generally perpendicular with the direction of cut 170 of insert 100 when insert 100 is at its most distant point from pin end 14 (and closest to the borehole bottom), while reference plane 125 is generally aligned with the direction of cut 170 when insert 100 is in this position.

To provide an aid to orient cutter insert 100 appropriately during manufacture, the insert 100 may include an alignment indicator. In this particular example, as best shown in FIGS. 5 and 10, such optional indicator may include a scored line or recess 180 generally oriented along reference axis 124. When insert 100 is fitted into cone 1, the insert is oriented such that alignment in indicator 180 is generally positioned along a radius extending outwardly from cone axis 22. In this manner, alignment indicator 180 will generally align with a projection 22*p* (FIG. 10) of the cone axis 22, and reference plane 125 will be generally aligned with the desired direction of cut 170. So positioned, it will be understood that leading upper quadrant 127 is closer to the pin end 14 than is leading lower quadrant 126. Likewise, when insert 100 is so positioned in the borehole, crest end 154 is closer to the pin end 14 than is crest end 152. Cutting surface 112 thus presents a non-planar surface in its engagement with the borehole. Nevertheless, although the cutting surface in this example does not constitute a sharp edge or chisel-shape, the cutter element 100 with crest 144 provides a more aggressive cutting surface (as compared to a conventional hemispherical cutting surface) as is useful for shearing formation material from the corner of the borehole. At the same time, cutter element 100 further provides a substantial volume of insert material behind leading crest 144 for strength, so as to buttress the leading section 120 as it engages the formation. Further, the partial dome-shaped trailing section provides a measure of relief so to reduce the tensile stresses imparted to the cutter element by the borehole as the cutter element rotates out of engagement with the formation.

Figure 12:
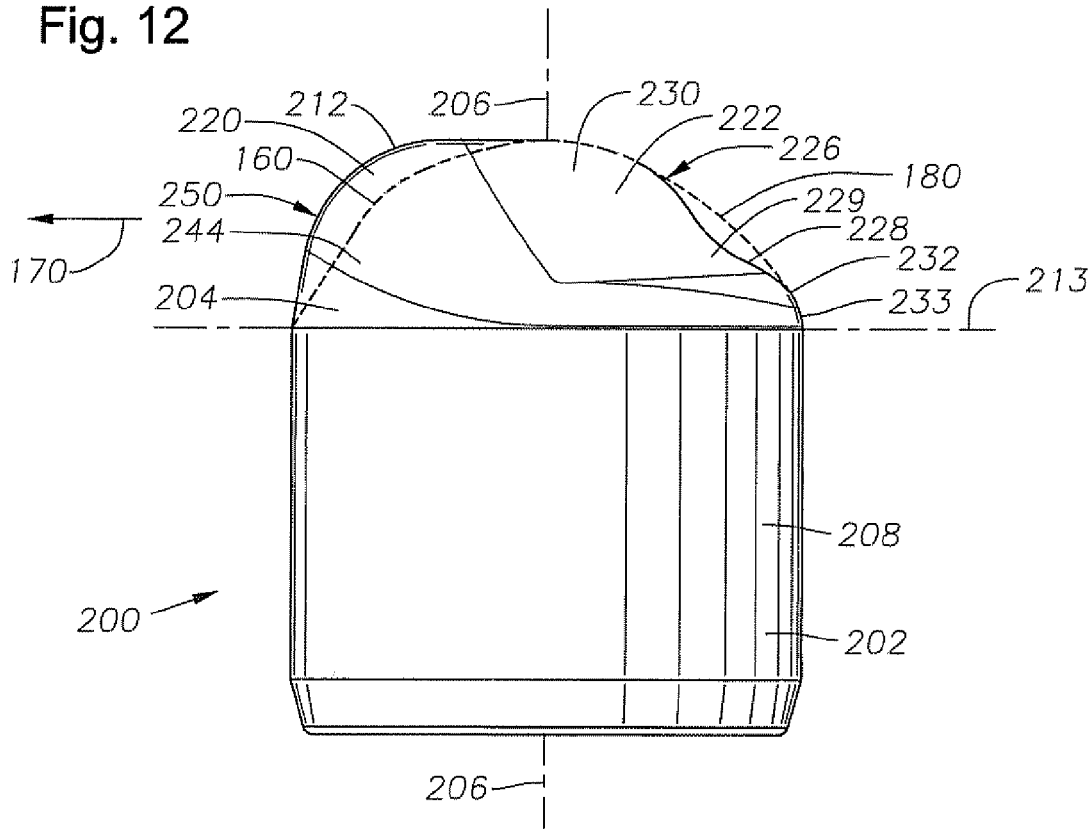
FIG. 12 a side elevation view of another cutter element made in accordance with the principles described herein and suitable for use in the drill bit of FIGS. 1 and 2.
Figure 13:
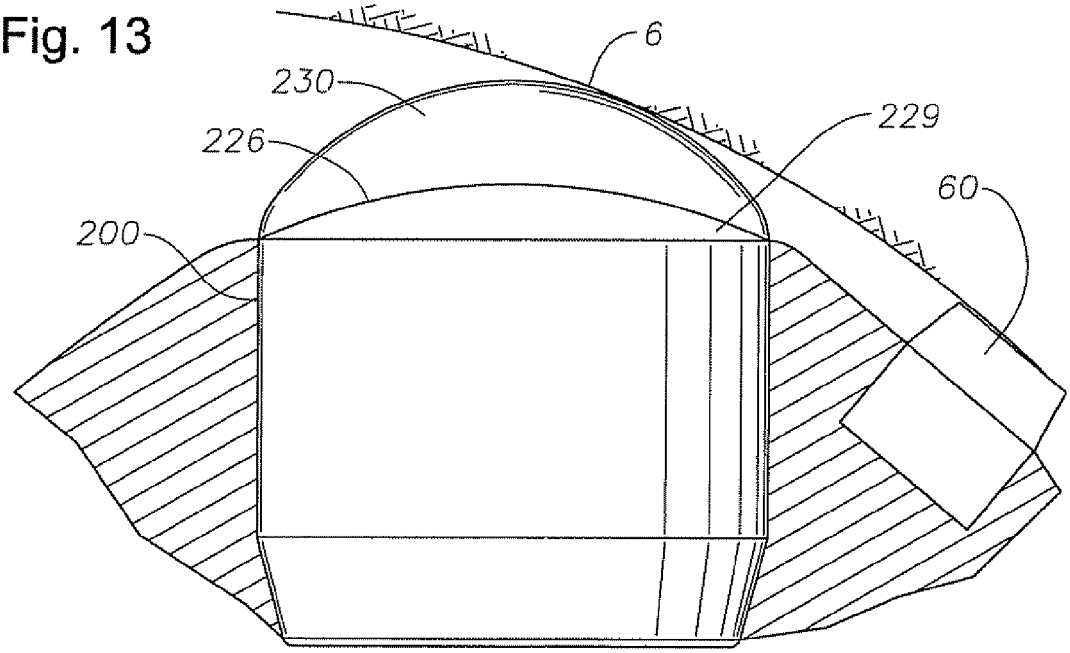
FIG. 13 is an enlarged, partial cross-sectional view of the cutter element of FIG. 12 shown from the rear as the cutter element engages the borehole.

Referring now to FIGS. 12 and 13, another cutter element 200, also having particular utility as a gage cutter element is shown. Cutter element 200 includes a generally cylindrical base portion 202, like base portion 102 previously described. Cutter element 200 further includes a cutting portion 204 having cutting surface 212 extending from a plane of intersection 213 that separates base portion 202 from cutting portion 204. Cutting surface 212 includes leading side 220 and trailing side 222 as generally divided by a reference plane passing through the insert base axis 206. As compared to the cutting surface 112 of insert 100 previously described, cutting surface 212 includes a leading crest 244 that has a larger radius along its length as compared to crest 144 of insert 100. In particular, the radius of leading crest 244 at leading portion 250 is approximately 0.070 inches for an insert having diameter 0.250. Accordingly, leading crest 244 of cutter element 200 has a much blunter and less-aggressive cutting surface as compared to surface 112 of cutter element 100. Nevertheless, crest 244 is sharper and more aggressive as compared to the cutting profile of a conventional hemispherical topped cutter element, as represented by dashed line 160 as before.

As best seen in FIG. 12, in this embodiment, trailing surface 222 of insert 200 is relieved to a greater extent relative to trailing surface 122 of insert 100. In particular, the profile of the partial dome-shaped surface 130 of trailing side 122 of cutter element 100 is represented in phantom by dashed line 180. As shown, the trailing side 222 of cutting surface 212 begins at a longitudinal reference plane encompassing axis 206, and includes a generally dome-shaped portion 230. However, at transition 226, the trailing surface 222 includes an inverted or negative radiused portion 228, creating a relieved region 229. Thereafter, trailing surface 222 includes generally rounded transition surfaces 232, 233 which blend the trailing surface 222 into the generally cylindrical side surface 208. The relieved region 229 of trailing surface 222 forms a generally wedge-shaped region as shown in FIG. 13 in a rear view of the cutter element.

As compared to cutter element 100, cutter element 200, although less aggressive on the leading side, may be more durable in harder formations. The relatively blunt leading side 220 (relative to cutter element 100) is more durable than the sharper leading side 120 of insert 100. As an insert leaves engagement with the formation, the portion of the insert last engaging the formation experiences tensile forces that can cause portions of the insert to shear away or otherwise become damaged. Providing the relieved region 229 of insert 200 provides additional stress relief to the insert as it leaves engagement with the formation material. As such, cutter element 200 is less likely to break or otherwise become damaged in harder formations. Further, cutter element 200 presents a cutting portion having more than 8% additional insert volume as compared to a standard hemispherical insert. Furthermore, after wear, the insert 200 still retains greater insert volume than the conventional hemispherical insert. For example, comparing after wear of 0.080 inches measured axially, insert 200 still provides over 19% greater volume of insert material compared to the similarly dimensioned, hemispherical topped insert.

The relieved trailing region 229 described with reference to insert 200 may likewise be employed on trailing side 122 of insert 100. Likewise, the more spherical or dome-shaped trailing surface 130 of insert 100 may equally be applied to the insert having a more rounded and blunt leading surface, such as surface 220 of insert 200.

Although the embodiments shown above have been disclosed with respect to cutter elements that comprise hard metal inserts, the concepts illustrated in these examples are applicable to bits in which some or all of the cutter elements are other than inserts, such as metal teeth formed from the cone material, as in steel tooth bits. More specifically, the cutter elements 100, 200 described herein may be employed as a tooth formed in a cone cutter in a steel tooth bit, or may be an insert separately formed and retained in the gage and heel locations of a cone cutter that includes steel teeth.

While preferred embodiments have been shown and described, modifications thereof can be made by one skilled in the art without departing from the spirit or teaching herein. The embodiments described herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed is:

1. A cutter element for a drill bit comprising:

a base having a base axis;

a cutting surface extending from said base, said cutting surface having a trailing section and a leading section, said leading section comprising a top surface, a front surface, and a crest formed at the intersection of said top surface and said front surface;

wherein said crest includes first and second ends and a forward-most portion that is farther from said trailing section than said first and second ends and is farther from said base portion than said first and second ends;

wherein said crest has a radius of curvature measured between said top surface and said front surface, the radius of curvature of the crest being non-uniform along said crest between said first and second ends;

wherein the radius of curvature of said crest is smallest at said forward-most portion;

wherein said trailing section includes a partial dome-shaped surface; and wherein said trailing section includes a relieved surface at a position between said dome-shaped surface and said base.

2. The cutter element of claim 1 wherein the radius of curvature of said crest is largest at a portion located between said forward-most portion and a first of said ends.

3. The cutter element of claim 1 wherein said front surface is generally frustoconical, and wherein said front surface tapers toward said base axis at an angle less than 20°.

4. A cutter element for a drill bit comprising:

a base having a base axis;

a cutting surface extending from said base, said cutting surface having a trailing section and a leading section, said leading section comprising a top surface, a front surface, and a crest formed at the intersection of said top surface and said front surface;

wherein said crest includes first and second ends and a forward-most portion that is farther from said trailing section than said first and second ends and is farther from said base portion than said first and second ends;

wherein said crest has a radius of curvature measured between said top surface and said front surface, the radius of curvature of the crest being non-uniform along said crest between said first and second ends;

wherein the radius of curvature of said crest is smallest at said forward-most portion wherein the radius of curvature of said crest is largest at a portion located between said forward-most portion and a first of said ends; and wherein the portion of said crest having said largest radius of curvature has a radius of curvature that is at least four times larger than the radius of said crest at said forward-most portion.

5. The cutter element of claim 4 wherein said trailing section includes a partial dome-shaped surface.

6. A drill bit for drilling a borehole in earthen formations, the bit comprising:

a bit body having a pin end and a bit axis;

at least one rolling cone cutter mounted on said bit body for rotation about a cone axis;

a plurality of cutter elements mounted to the at least one rolling cone cutter, wherein at least one of the plurality of cutter elements comprises:

a base portion having a central axis;

a cutting portion extending from said base and having a cutting surface comprising a leading section and a trailing section, said leading section comprising:

a generally frustoconical front surface intersecting a top surface to form a crest having a first end, a second end, a forward-most portion between said ends, and a radius of curvature measured between said top surface and said front surface;

wherein said crest is curved, and wherein the radius of curvature of said crest at each of said ends is larger than the radius of curvature of said crest at said forward-most portion;

wherein said crest includes portion of maximum radius of curvature and wherein said portion of maximum radius of curvature is located between said forward-most portion and one of said ends.

7. The drill bit of claim 6 wherein said frustoconical front surface, in profile, tapers toward said central axis at an angle not greater than 20°.

8. The drill bit of claim 6 wherein said forward most portion of said crest is farther from said base portion than each of said crest ends.

9. The drill bit of claim 6 wherein said trailing section includes a partial dome-shaped surface extending away from said central axis and toward said base portion.

10. The drill bit of claim 6 wherein said radius of curvature of said crest at said first end is at least three times larger than the radius of said crest at said forward-most portion.

11. The drill bit of claim 10 wherein said crest has a region having a maximum radius of curvature located between said forward-most portion and one of said ends, and wherein said region of maximum radius of curvature has a radius that is at least five times larger than the radius of curvature of said crest at said forward-most portion.

12. The drill bit of claim 6 wherein, in a profile view, said top surface extends from said central axis toward said forward-most portion in a profile that is generally perpendicular to said base axis.

13. The drill bit of claim 6 wherein in a profile view, said cutting surface presents a generally hemispherical surface.

14. A drill bit having a nominal gage diameter for drilling a borehole in earthen formations, the bit comprising:

a bit body having a pin end and a bit axis;

at least one rolling cone cutter mounted on said bit body for rotation about a cone axis;

a first circumferential row of cutter elements having cutting portions extending to full gage diameter for cutting the corner of the borehole, at least a first of said cutter elements having a base portion retained in said cone cutter, a central axis, and a cutting portion extending from said base and having a cuffing surface comprising leading and trailing sections, wherein said leading section of said cutting surface comprises:

a non-linear crest having first and second ends, said crest defined by the intersection of a front surface and a top surface, said crest having a radius of curvature measured between the top surface and the front surface, wherein said radius of curvature is non-uniform along the crest between said first and second ends;

wherein said crest includes a forward-most portion and first and second end portions, said forward-most portion having a smaller radius of curvature than the radius of curvature of said end portions; and wherein said crest further includes a portion of maximum radius of curvature that is located between said forward-most portion and a first of said ends;

said cutter element being positioned in said cone cutter such that said first end is closer to said pin end than said second end when said cutter element engages the formation material.

15. The drill bit of claim 14 wherein said cutter element is positioned in said cone cutter such that said intersection of said leading and trailing section is substantially aligned with a projection of said cone axis.

16. The drill bit of claim 14 wherein said forward-most portion of said crest is farther from said cutter element base portion than said first and said second ends, and wherein said forward-most portion of said crest is farther from said central axis than each of said first and said second ends.

17. The drill bit of claim 14 wherein said trailing surface includes a partial dome-shaped surface extending away from said central axis towards said base.

18. The drill bit of claim 14 further comprising an alignment indicator on said cutting surface.

19. The drill bit of claim 18 wherein said cutter element is oriented in said cone cutter with said alignment indicator generally aligned with a projection of said cone axis.

20. A drill bit for cutting a borehole through earthen formations having a sidewall, corner and bottom, the bit comprising:

a bit body;

a pin end on said body;

a cone cutter mounted on said bit body for rotation about a cone axis and having a mounting surface for retaining cutter elements therein;

a cutter element mounted in said cone cutter and positioned to cut the corner of the borehole and comprising a cutting surface having leading and trailing sections, wherein said leading section includes a front surface that tapers toward said trailing section and a top surface that intersects said front surface in a radiused intersection having first and second ends, and a forward-most portion therebetween;

wherein said radiused intersection has a radius of curvature measured between the front surface and the top surface, and wherein said radius of curvature is smallest at said forward-most portion and greatest at a portion of maximum radius of curvature located between said forward-most portion and said first end; and wherein said cutter element is mounted in said cone cutter such that when said cutter element is farthest from said pin end, said first end of said radiused intersection is closer to said pin end than said second end of said radiused intersection.

21. The drill bit of claim 20 wherein said trailing section further includes a partial dome-shaped surface adjacent to said leading section and a relieved portion disposed between said partial dome-shaped surface and said cutter element base.

22. The drill bit of claim 20 wherein said the radius of said portion of maximum radius of curvature is at least five times larger than the radius of curvature of said forward-most portion of said radiused intersection.

23. The drill bit of claim 20 wherein said front surface of said cutter element is generally frustoconical.

24. The drill bit of claim 20 wherein said radiused intersection is non-linear between said first and second ends, said forward-most portion being farther from said mounting surface of said cone cutter than each of said first and second ends.

25. The drill bit of claim 20 wherein said trailing section of said cutter element includes a partial dome-shaped surface extending away from said leading section.

26. The drill bit of claim 25 wherein said trailing surface further includes a relieved surface having a negative radius of curvature.

* * * * *

UNITED STATES PATENT AND TRADEMARK OFFICE

CERTIFICATE OF CORRECTION

PATENT NO. : 7,624,825 B2
APPLICATION NO. : 11/253121
DATED : December 1, 2009
INVENTOR(S) : Amardeep Singh It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 654 days.

Signed and Sealed this

Twenty-first Day of December, 2010

David J. Kappos

David J. Kappos
*Director of the United States Patent and Trademark Office*